US010071554B2

(12) United States Patent
Garvi et al.

(10) Patent No.: US 10,071,554 B2
(45) **Date of Patent: *Sep. 11, 2018**

(54) MODULAR PRINT ENGINE UNIT

(71) Applicant: HEWLETT-PACKARD DEVELOPMENT COMPANY, L.P., Houston, TX (US)

(72) Inventors: Joaquim Brugue Garvi, Barcelona (ES); Daniel Gonzalez Perello, Terrassa (ES); Rafael Ulacia Portoles, Barcelona (ES); Oscar Moya Rojo, Sant Cugat del Valles (ES); Eduardo Ruiz Martinez, Sant Cugat del Valles (ES); Joan Sanjuan, Sant Cugat del Valles (ES); Alfonso Cameno Salinas, Barcelona (ES); Francesc Roure Pastor, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/838,838

(22) Filed: Dec. 12, 2017

(65) Prior Publication Data

US 2018/0099501 A1 Apr. 12, 2018

Related U.S. Application Data

(63) Continuation of application No. 15/316,408, filed as application No. PCT/EP2014/061758 on Jun. 6, 2014, now Pat. No. 9,873,253.

(51) Int. Cl.

| | |
|---|---|
| ***B41J 2/14*** | (2006.01) |
| ***B41J 2/16*** | (2006.01) |
| ***B41J 2/145*** | (2006.01) |
| ***B41J 2/045*** | (2006.01) |

(52) U.S. Cl.
CPC ..... *B41J 2/145* (2013.01); *B41J 2/04505* (2013.01); *B41J 2/04586* (2013.01)

(58) Field of Classification Search
CPC ..... B41J 2/04505; B41J 2/04586; B41J 2/145
USPC ..... 347/40, 45, 47, 49
See application file for complete search history.

(56) References Cited

U.S. PATENT DOCUMENTS

| | | | |
|---|---|---|---|
| 6,890,061 | B1 | 5/2005 | Freire |
| 7,273,325 | B2 | 9/2007 | Watanabe |
| 7,817,306 | B2 | 10/2010 | Silverbrook |
| 8,262,190 | B2 | 9/2012 | Mizes |
| 8,425,132 | B2 | 4/2013 | Bouverie |
| 8,529,007 | B2 | 9/2013 | Folins |
| 9,440,442 | B2 | 9/2016 | Sheffelin |
| 2009/0244124 | A1 | 10/2009 | Kondo |

(Continued)

FOREIGN PATENT DOCUMENTS

| | | |
|---|---|---|
| EP | 1182037 | 2/2002 |
| EP | 1186417 | 3/2002 |

*Primary Examiner* — An Do
(74) *Attorney, Agent, or Firm* — HP Inc. Patent Department

(57) ABSTRACT

A modular print engine unit for a media-wide array printer includes multiple printhead modules, each printhead module having printing dies, and each printing die having multiple nozzles. The modular print engine unit is independently operable relative to another modular print engine unit within the media-wide array printer.

20 Claims, 16 Drawing Sheets

(56) References Cited

U.S. PATENT DOCUMENTS

| | | | | |
|---|---|---|---|---|
| 2010/0220136 | A1 | 9/2010 | Sheahan | |
| 2017/0144436 | A1* | 5/2017 | Brugue Garvi | B41J 2/145 |

* cited by examiner

MODULAR PRINT ENGINE UNIT

CROSS-REFERENCE TO RELATED APPLICATION

This application is a continuation of U.S. application Ser. No. 15/316,408 filed Dec. 6, 2016, which is a U.S. National Stage Application of and claims priority to International Patent Application No. PCT/EP2014/061758, filed on Jun. 5, 2014, and entitled "MODULAR PRINT ENGINE UNIT," which is hereby incorporated by reference in its entirety.

A media-wide array configuration for a printing apparatus, such as an inkjet printer, comprises one or several rows of nozzles that are arranged in an array that is as wide as the media to be printed. The media to be printed may be passed just once under such nozzles during a printing operation, enabling high printing speed.

BRIEF DESCRIPTION OF THE DRAWINGS

For a better understanding of examples described herein, and to show more clearly how the examples may be carried into effect, reference will now be made, by way of example only, to the following drawings in which.

DETAILED DESCRIPTION

Figure 1:
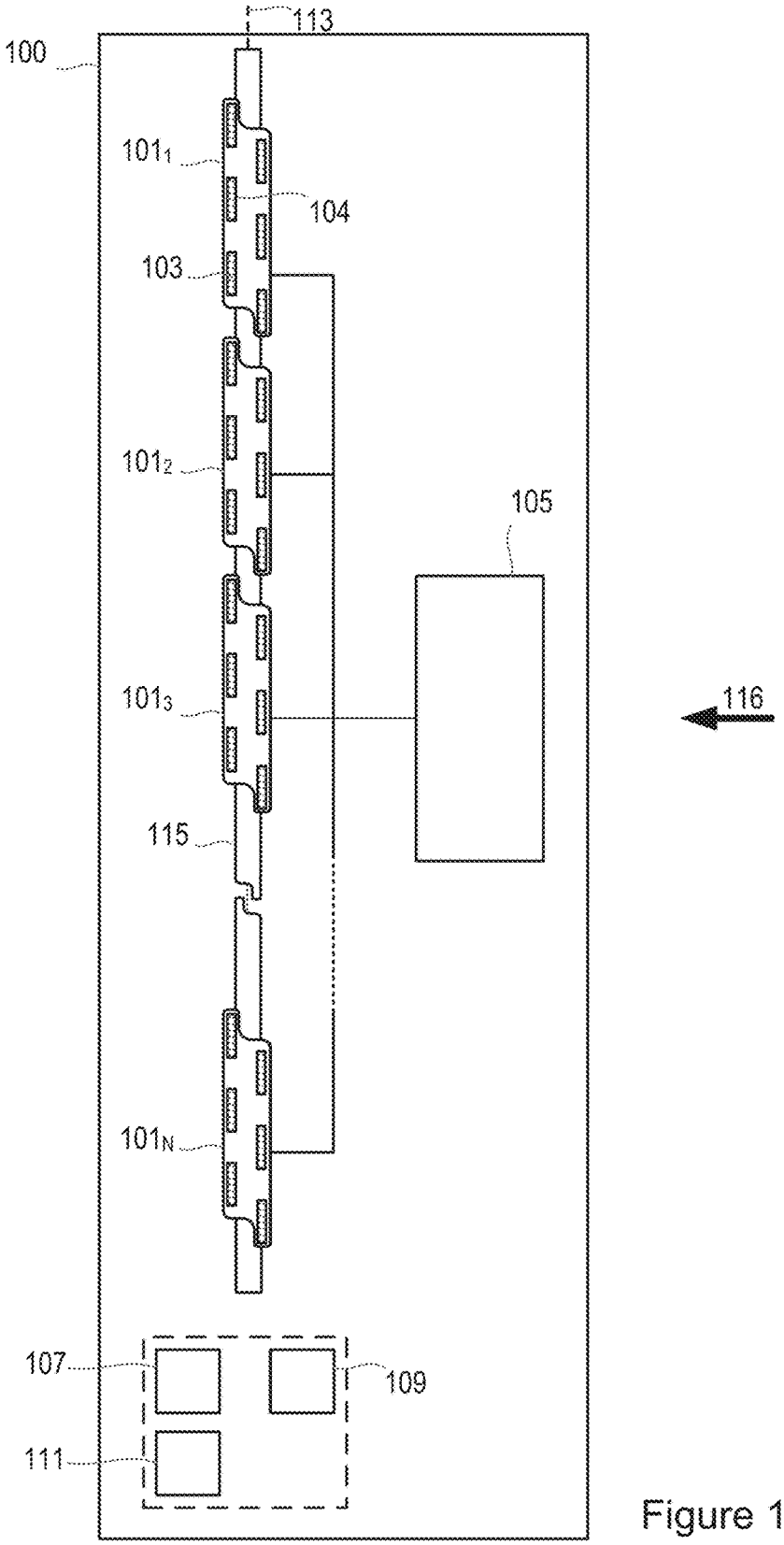
FIG. 1 shows an example of a modular print engine unit.

FIG. 1 shows an example of a modular print engine unit 100 for independently operable use in a media-wide array printing apparatus. The modular print engine unit 100 comprises multiple printhead modules $\mathbf{101}_1$ to $\mathbf{101}_N$. Each printhead module 101 comprises multiple printing dies $\mathbf{104}_1$ to $\mathbf{104}_M$, with each printing die comprising multiple nozzles 103 (for example arranged in X rows of nozzles). The modular print engine unit 100 comprises a printing fluid supply system 105 to feed, in use, printing fluid to the multiple printhead modules. Furthermore, the modular print engine unit 100 comprises a print alignment module 107 operable, in use, to align the multiple printhead modules, for example relative to a media being printed, and an error detection module 109 which is operable, in use, to detect an operating status of the multiple nozzles (for example for proper operation, such as being blocked or working, or detecting drop volume status, or drop trajectory status). The modular print engine unit 100 further comprises a service sub-system 111 operable, in use, to service the multiple nozzles.

During use, media to be printed is moved in a media advance direction 116, which is a direction substantially orthogonal to an axis 113 on which the printhead modules 101 may be arranged (the axis 113 also referred to as a pen direction, or printhead direction, or page width direction).

The media to be printed travels below or opposite the plurality of nozzles (or in front of them in a vertical printer).

The examples described herein provide a compact layout for a modular print engine unit, and provide for example a complete inkjet print engine for a large format printer. By complete it is meant that each modular print engine unit 100 is independently operable, and comprises printing fluid hardware, (for example color printing hardware, such as mechanical and electrical hardware, for X printing fluids, for example four color inks, via the printing fluid supply system), servicing hardware, error detection mechanisms, and print alignment mechanisms. It is noted that the modular print engine unit 100 may comprise other functional units if desired.

A media-wide array printing apparatus may comprise a plurality of modular print engine units 100, each of the modular print engine units 100 being independently operable.

Figure 2:
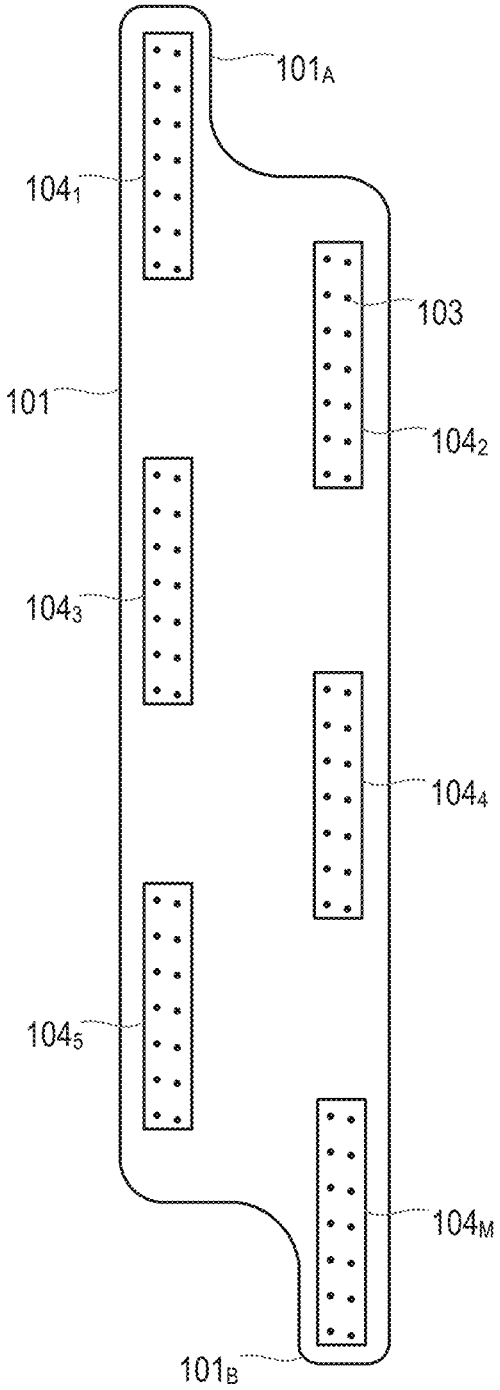
FIG. 2 shows an example of a printhead module for use with a modular print engine unit of FIG. 1 in further detail.

FIG. 2 shows further details of an example of a printhead module 101 for use in a modular print engine unit 100 as shown in FIG. 1. As indicated above each printhead module 101 in the set of printhead modules $\mathbf{101}_1$ to $\mathbf{101}_N$ comprises a set of printing dies $\mathbf{104}_1$ to $\mathbf{104}_M$. The printing dies are arranged, for example, in two rows. The printing dies 104 are arranged along the length of the printhead module 101. The printing dies $\mathbf{104}_1$ to $\mathbf{104}_M$ are arranged to overlap so as to cover substantially the length of the printhead module (such that nozzles are effectively provided substantially along the length of the printhead module, with the overlap enabling the discontinuity of the printing dies to be hidden, such that an image quality (IQ) artifact is not produced).

Although two rows of nozzles 103 are shown within a printing die 104 in FIGS. 1 and 2 for purposes of clarity, it is noted that a printing die may comprise any number X of rows of nozzles. For example, in a modular print engine unit 100 that is configured to print four inks, four rows of nozzles 103 may be provided in each printing die 104 (e.g. a row for each of the colors Cyan, Magenta, Yellow blacK, CMYK).

As can be seen from FIGS. 1 and 2, according to one example the multiple printhead modules $\mathbf{101}_1$ to $\mathbf{101}_N$ are arranged on a common printhead axis 113. A first end $\mathbf{101}_A$ of a printhead module comprises a protruding printing die ($\mathbf{104}_1$ in the example of FIG. 2), for overlapping in use with a protruding printing die from a printhead module adjacent to the first end. A second end $\mathbf{101}_B$ of the printhead module comprises a protruding printing die ($\mathbf{104}_M$ in the example of FIG. 2), for overlapping in use with a protruding printing die from a printhead module adjacent to the second end.

By shaping the printhead modules 101 in this way, in an S-shaped configuration, this enables the printhead modules to be arranged in a single row of printhead modules, along the common printhead axis 113, and still obtain an overlap of the printhead modules 101 (and of the printing dies 104 within the printhead modules 101, and hence the nozzles 103 within the printing dies 104). This allows the printhead modules 101 to be mounted on a single printhead bar 115, which enables the printhead modules to be serviced and cleaned more easily, as will be explained later in the application. Furthermore, this arrangement enables the size of the device to be reduced. In other words, the S-shape of the printhead modules 101 allows the printer to have the nozzles of a print engine to be provided in a very narrow strip (referred to as a printzone), because the printhead modules can be arranged in one single row and still made to overlap one another in order to provide nozzles along the length of the modular print engine unit in a continuous manner (and for example along the width of the media-wide array printer). Without the S-shape the printhead modules would need to be staggered on different axes, for example similar to how the printing dies 104 are arranged in FIG. 2 within a printhead module. By enabling the printhead modules 101 to be arranged on a common axis, this minimizes image quality errors that grow with the distance between nozzles printing in the same spot of the media. The S-shape also enables the number of printhead modules to be increased, without increasing the width of the printzone. This S-shape also allows scalability of the design since, by adding more S-shaped printhead modules, the width of the array can be made as wide as needed to print wider media.

In the example of FIG. 2 it can be seen that the protruding printing die of the first end $\mathbf{101}_A$ protrudes from a first row of printing dies, and the protruding printing die of the second end $\mathbf{101}_B$ protrudes from a second row of the printing dies. The first and second rows correspond to upstream and downstream rows in relation to the direction in which the media advances.

In an example of a printer apparatus application, a set of printhead modules 101 (for example comprising a set of eight S-shaped printhead modules) can be used to create a modular print engine unit with a width of about 40". The printhead modules comprise, for example, six printing dies 104, each having four rows of nozzles (for the four different inks CMYK). The printing dies 104 can be arranged to overlap as shown, such that any discontinuity of the dies can be hidden, such that it does not produce a visible image quality (IQ) artifact. The printhead modules 101, having an S shape, can be arranged such that there is also an overlap between printhead modules. Thus, from the above, it can be seen that the S-shape of the printhead modules allows a printer apparatus to have all the nozzles in arranged in a narrow strip (printzone).

The modular print engine unit 100 may further comprise a printhead bar 115 to mount the multiple printhead modules $\mathbf{101}_1$ to $\mathbf{101}_N$ along a common printhead axis 113 (as shown in FIG. 1).

The printhead bar 115 may comprise, for example, a single beam upon which the printhead modules 101 are hung on one side, which supports and locates accurately the printhead modules. The printhead bar 115 can move up and down relative to the media being printed (or away from, or towards the media being printed), as will be explained in further detail later in the application.

Figure 3:
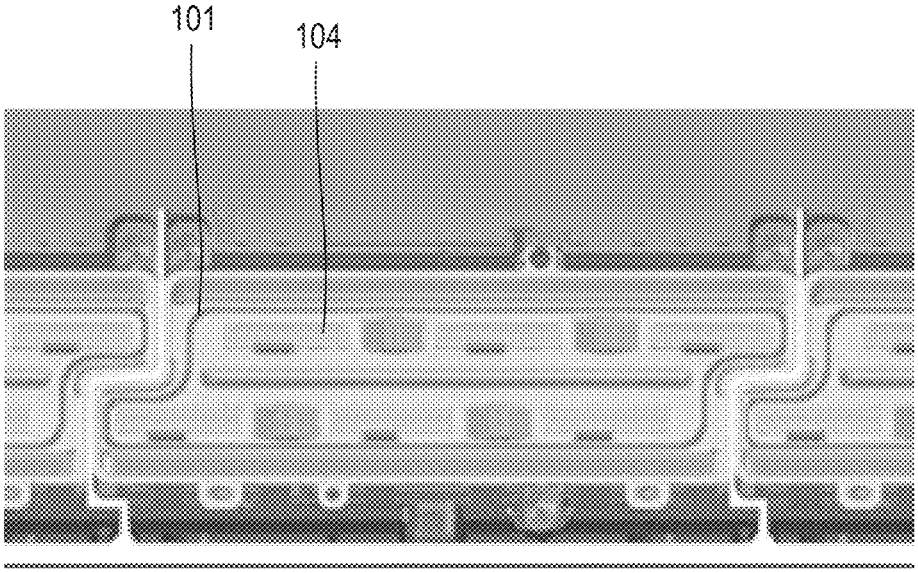
FIG. 3 shows an example of a printhead module in situ in an example of an application.

FIG. 3 shows an example of a printhead module 101 in situ with other printhead modules in an example of an application, and illustrates further the S-shape of each printhead module 101, and how the printing dies 104 are arranged to overlap within a printhead module 101.

The modular print engine unit 100 described above provides the functionality needed to print in a compact way (for example about 210 mm in depth) which enables multiple printhead bars to be used in parallel, if desired in a particular application, in a reasonable space, and minimizes image quality errors that grow with the distance between print engines.

According to one example, a lifting mechanism 400 may be coupled to the printhead bar 115, for moving the printhead bar 115 towards or away from the media being printed.

The lifting mechanism 400 enables the printhead bar 115 to be moved up and down relative to media (or away from or towards the media), such that the printer apparatus can easily accept different media thicknesses.

FIGS. 4*a* to 4*e* show an example of a lifting mechanism 400 for moving the printhead bar 115 towards or away from the media being printed.

Figure 4A:
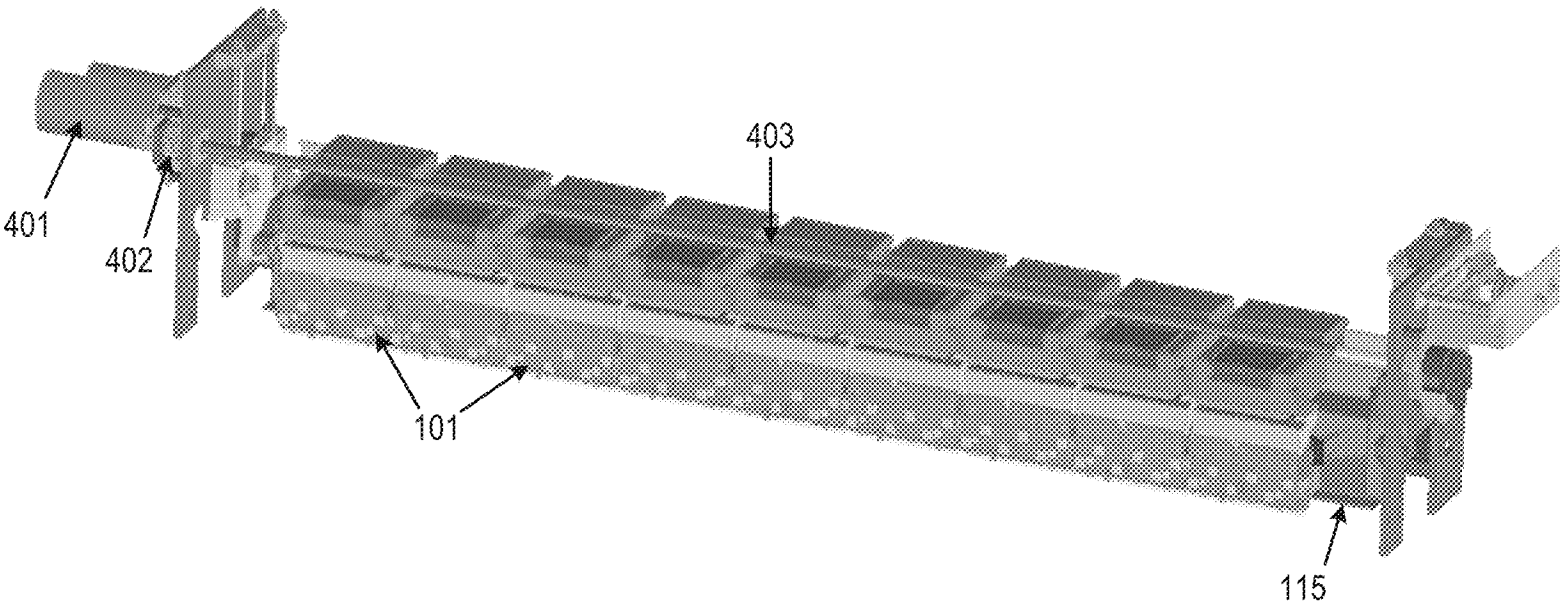
FIGS. 4*a* to 4*e* show an example of a sifting mechanism.

FIG. 4*a* shows an overview of how a printhead bar 115 (with printhead modules 101 being shown as fitted in the example, for example having nine printhead modules 101 fitted) interfaces with a drive motor 401 and a gearing mechanism 402 (for example reduction gearing mechanism) of the lifting mechanism 400. A synchronization rod 403 may be provided to synchronize the lifting of the respective ends of the printhead bar 115.

Figure 4B:
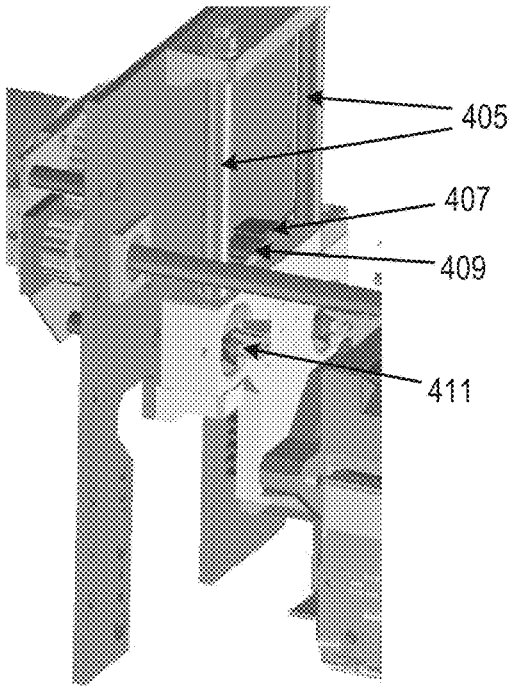

Referring to FIG. 4*b*, which shows one end of the lifting mechanism, the lifting mechanism comprises a guide rod 405 (for example comprising first and second separate guide rods in the example of FIG. 4*b*) to guide the lifting mechanism as the printhead bar is raised or lowered, and a lift actuator comprising a rack and pinion arrangement (comprising a rack 407 and pinion 409), the rack 407 and pinion 409 controlled by the drive motor 401 via the gear mechanism 402. The moveable rack 407 (which is attached to the printhead bar) is driven up or down by the rotation of the fixed pinion 409, with the guide rod(s) 405 guiding this movement. The rack 407 and the respective pinion 409 and guide rod(s) 405 are arranged in this example on both ends of the printhead bar, the operation of which may be synchronized using a synchronization bar 403 as described above.

Thus, in FIG. 4*b* the guide rods 405 act to guide the lifting and lowering of the printhead bar 115, with the rack 407 and pinion 409 being driven by the drive motor 401 via the gearing mechanism 402. The lifting mechanism may comprise a brake 411 as shown in FIG. 4*b*.

Figure 4C:
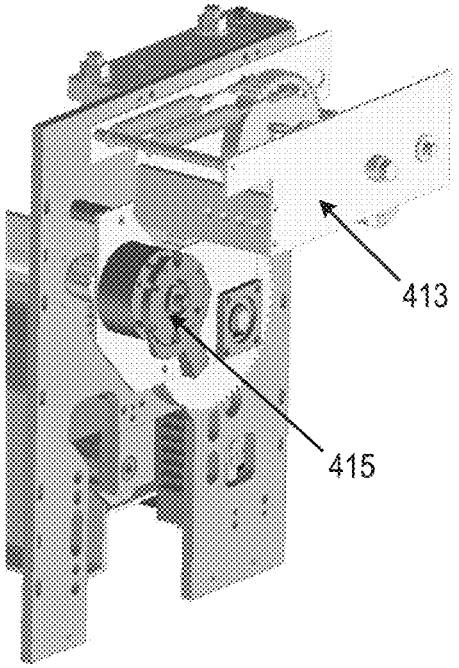

FIG. 4*c* shows further details of a brake actuator 413 and an alternative brake 415.

Figure 4D:
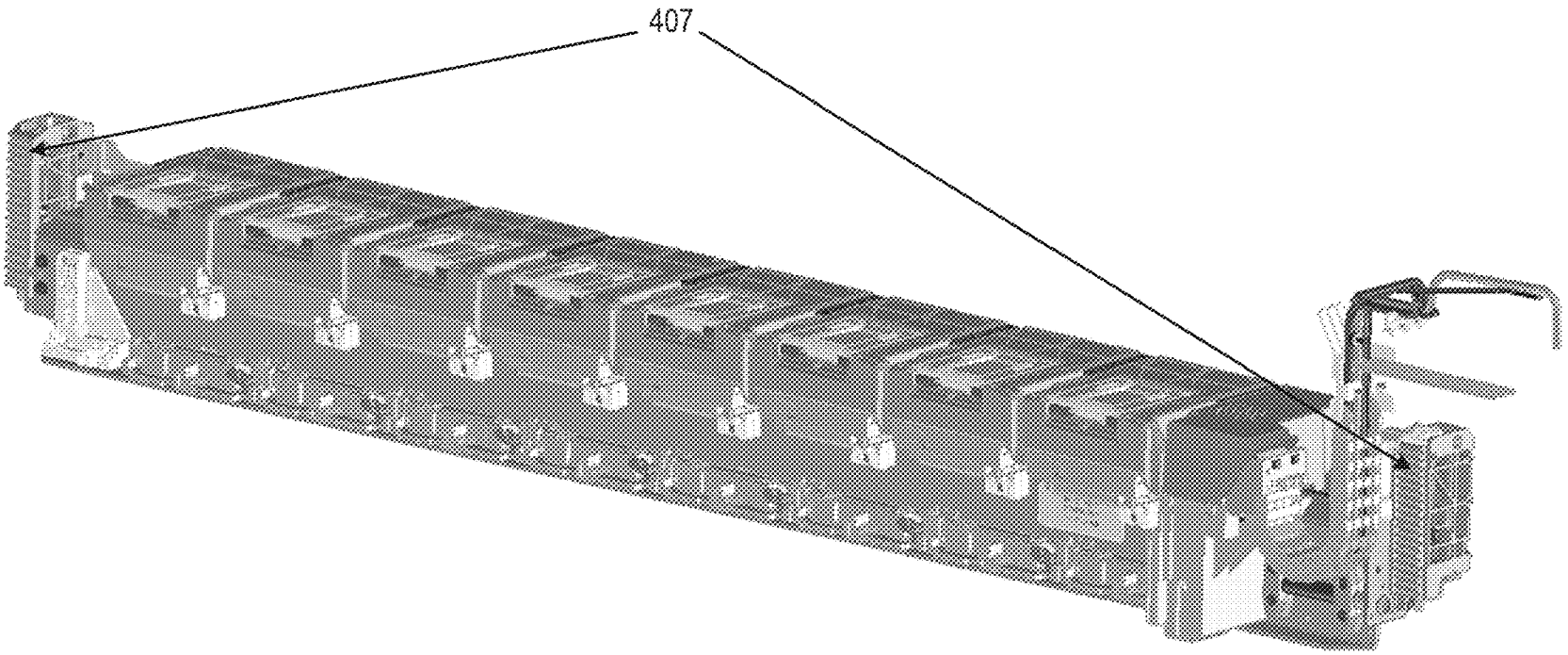

FIG. 4*d* shows another illustration of an example of the printhead bar 115 (with the printhead modules removed in this example), showing in further detail first and second racks 407 on respective ends of the lifting mechanism.

Figure 4E:
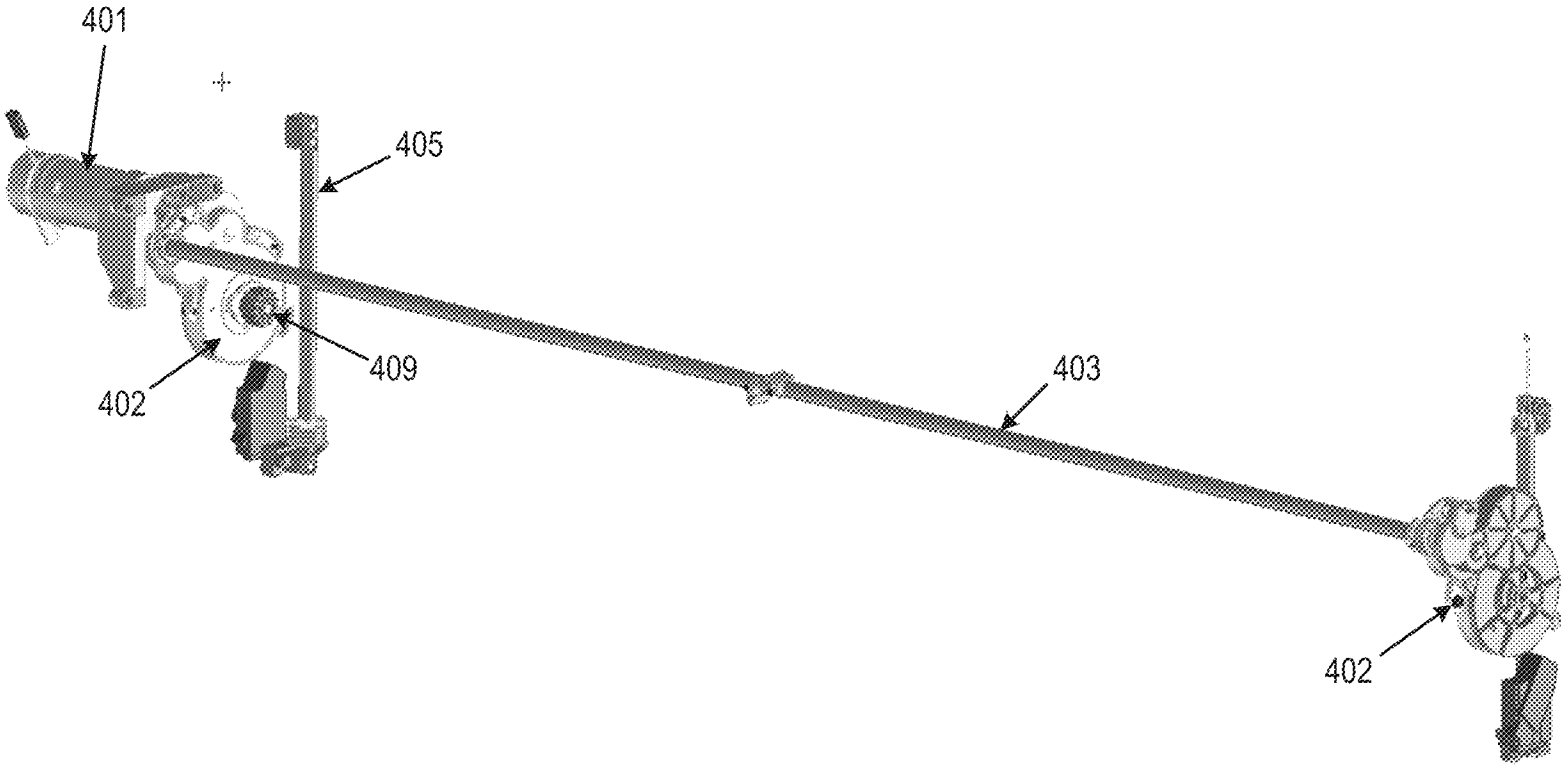

FIG. 4*e* is another illustration of an example of the lifting mechanism 400, showing the drive motor 401, a guide rod 405 (which guides a corresponding bushing provided on the printhead bar, not shown), the pinion 409 which engages and drives the moving rack 407 (the moving rack 407, not shown, being attached to the printhead bar, also not shown). The gear mechanism 402 is coupled between the drive motor 401 and the pinion 409, for reducing the speed of the drive motor 401.

The lifting mechanism 400 may also comprise first and second stops (not shown) that are arranged to provide a selected distance between the set of printhead modules and the media being printed.

The lifting mechanism enables both sides of the machine to move at the same time because they are linked through a synchronization bar 403. The printhead bar 115, during printing, rests on the first and second stops that provide the correct distance between the printhead modules and the media to be printed.

An adjusting mechanism may be provided to move the first and second stops, thereby adjusting the distance between the printhead modules and the media to a selected distance.

The provision of an adjusting mechanism to move the first and second stops in a vertical direction (i.e. perpendicular to a plane of the media being printed) can be fitted to enable the printing height to accommodate a range of media thicknesses.

The lifting mechanism also provides a means for moving the printhead bar 115 up and down for other printing operations, for example wiping, capping, spitting, priming, drop detection, printhead module replacement and printhead module alignment, in addition to printing.

In one example the printhead bar 115 comprises at least one interface for coupling to at least one respective interface on the set of printhead modules $\mathbf{101}_1$ to $\mathbf{101}_N$.

The at least one interface may comprise, for example:

- a plurality of mechanical interfaces to locate the set of printhead modules accurately;
- a plurality of fluid interfaces to feed the set of printhead modules with printing fluid, for example ink, for example to feed the printhead modules with four different inks; and
- a plurality of electrical interfaces to feed the set of printhead modules with power and data.

Thus, since the printer apparatus is modular with a clear set of interfaces, this has the advantage of simplifying its reuse in different printer architectures and sizes.

In one example the printhead bar 115 comprises a latching mechanism for attaching and detaching a printhead module 101 to the printhead bar. The latching mechanism provides a means to replace printhead modules 101 and latch them into place. The latching mechanism attaches a printhead module to the printhead bar and ensures the proper operation of all the interfaces (both mechanical, such as fluid, and electrical).

According to another example the modular print engine unit 100 comprises a capping mechanism 117, wherein the capping mechanism protects the nozzles 103 when the printer apparatus is not in use. This has the advantage of keeping the nozzles 103 in a good condition while the nozzles are not being used, and protects the nozzles from drying.

Figure 5A:
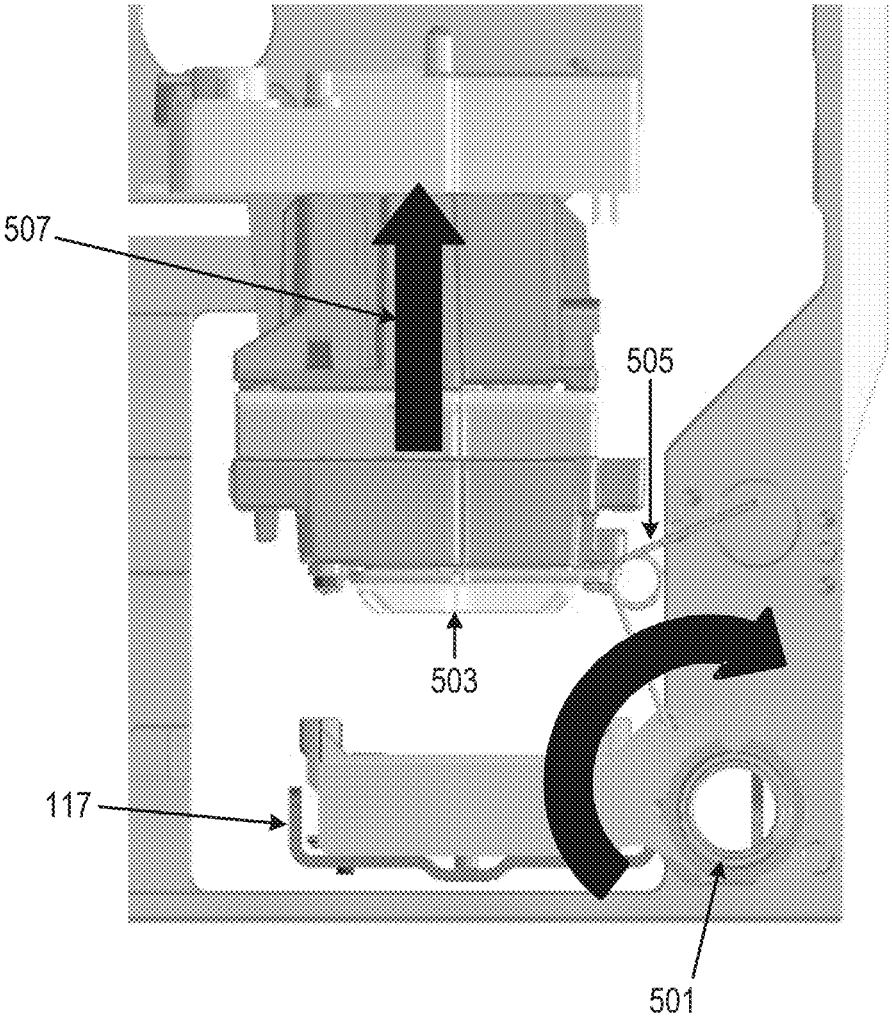
FIGS. 5*a* and 5*b* show an example of a capping mechanism.

Referring to FIG. 5*a*, there is shown an example of a capping mechanism 117. In this example the capping mechanism is pivotably coupled to a static part of the modular print engine unit, for example pivotably coupled about a shaft 501. The pivotable coupling enables the capping mechanism 117 to pivot and reside under the nozzles 103 of the printhead modules 101 when the printer apparatus is not in use. The capping mechanism 117 can be pivoted to reside in a position beside the printhead modules 101 when the printer is in use (for example folded vertically to take less space). Reference 503 illustrates the location in which the nozzles may be positioned, close to the media, when printing. Reference 505 shows a torsional spring that may be used, for example, to pivot the capping mechanism 117 about its shaft 501, between capping and non-capping positions. Reference 507 illustrates the up and down movement of the printhead bar by the lifting mechanism described above.

Figure 5B:
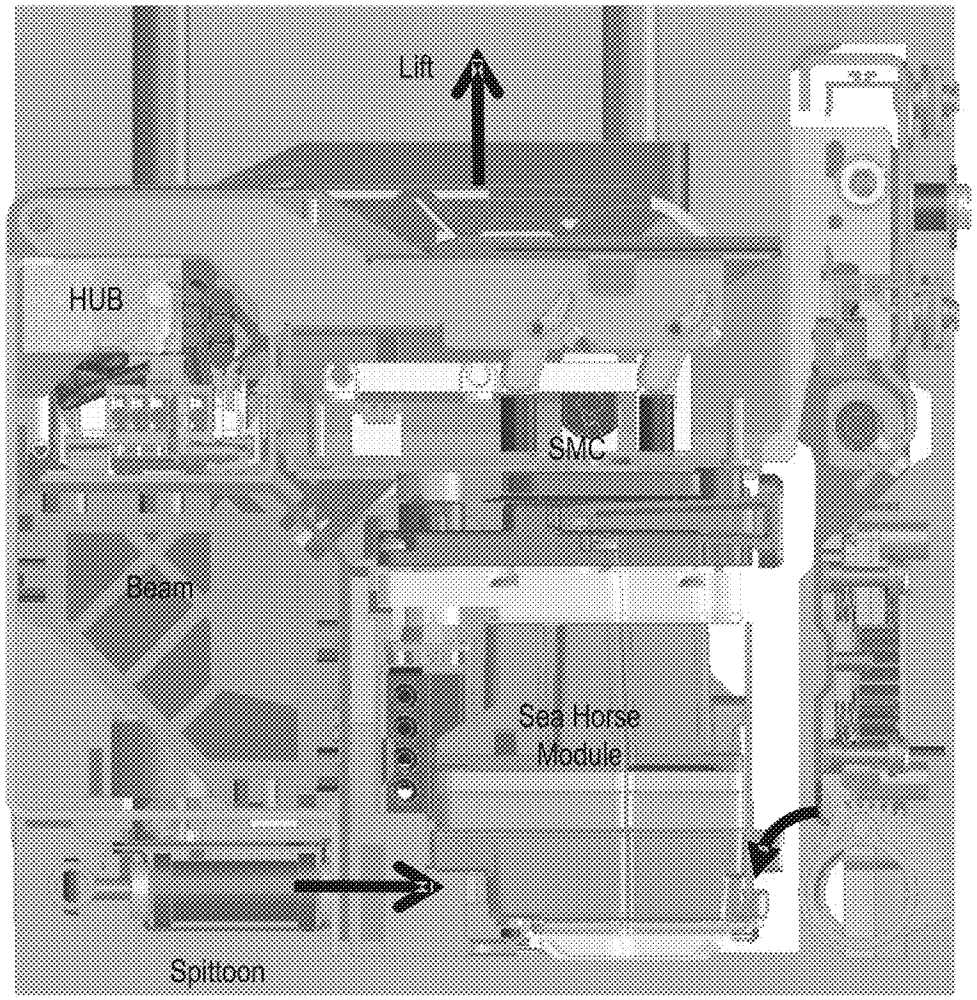

FIG. 5*b* shows a further illustration of how the capping mechanism may be arranged with other components in an example.

The pivotable action of the capping mechanism 117 enables the capping mechanism 117 to stay under the printhead modules 101 and seal a nozzle plate of the printhead modules to avoid the ink getting dry while the printer is not printing (i.e. in a capping position). To print, the printhead bar 115 is raised, the capping mechanism 117 pivoted to allow it to be folded vertically beside the printhead modules 101 (to a folded position), with the printhead bar 115 then being lowered back down over the print zone at the printing position. In the folded position the capping mechanism 117 takes little space in the media movement direction. This is because, in the folded position, the capping mechanism 117 resides above the printhead modules.

Figure 6A:
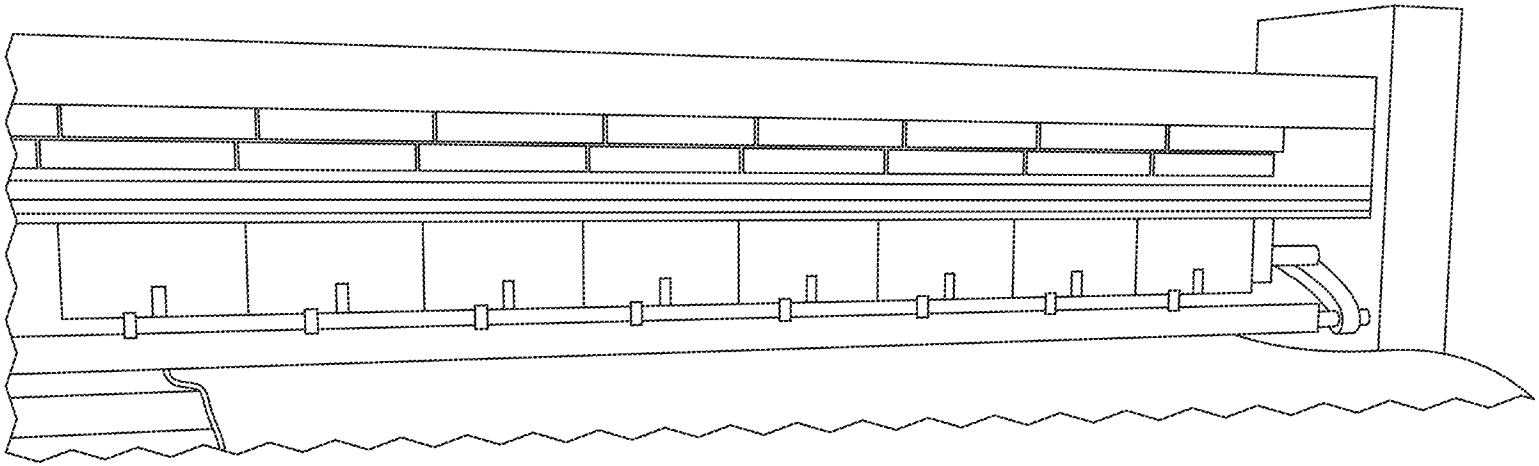
FIGS. 6*a*, 6*b* and 6*c* shows photographs of an example of a capping mechanism.
Figure 6B:
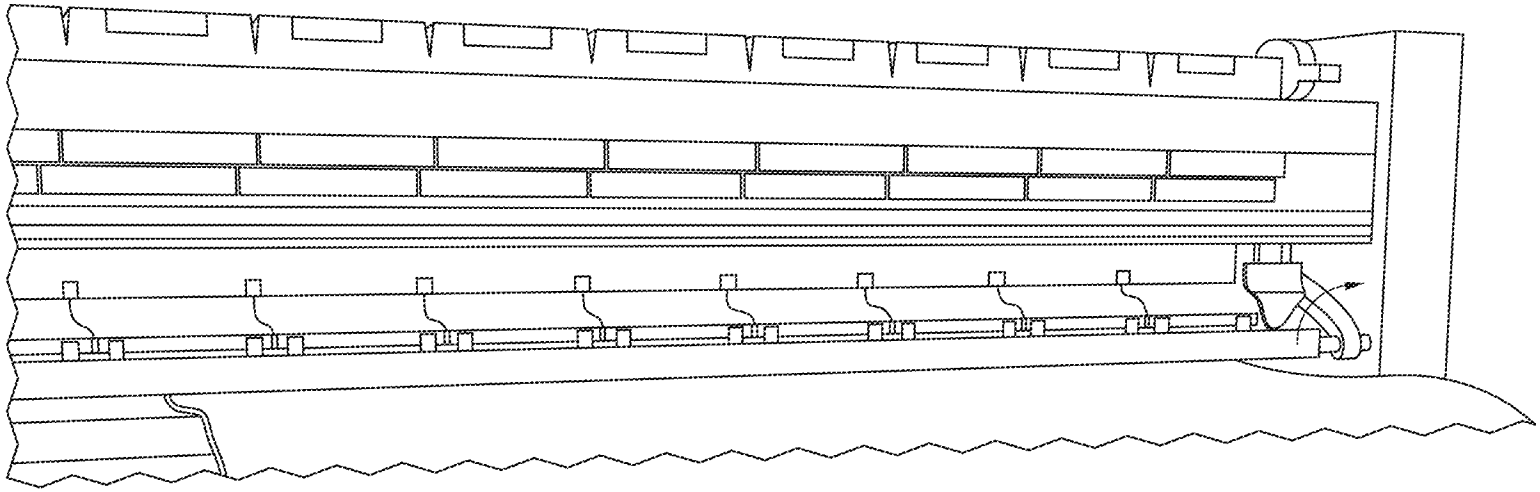
Figure 6C:
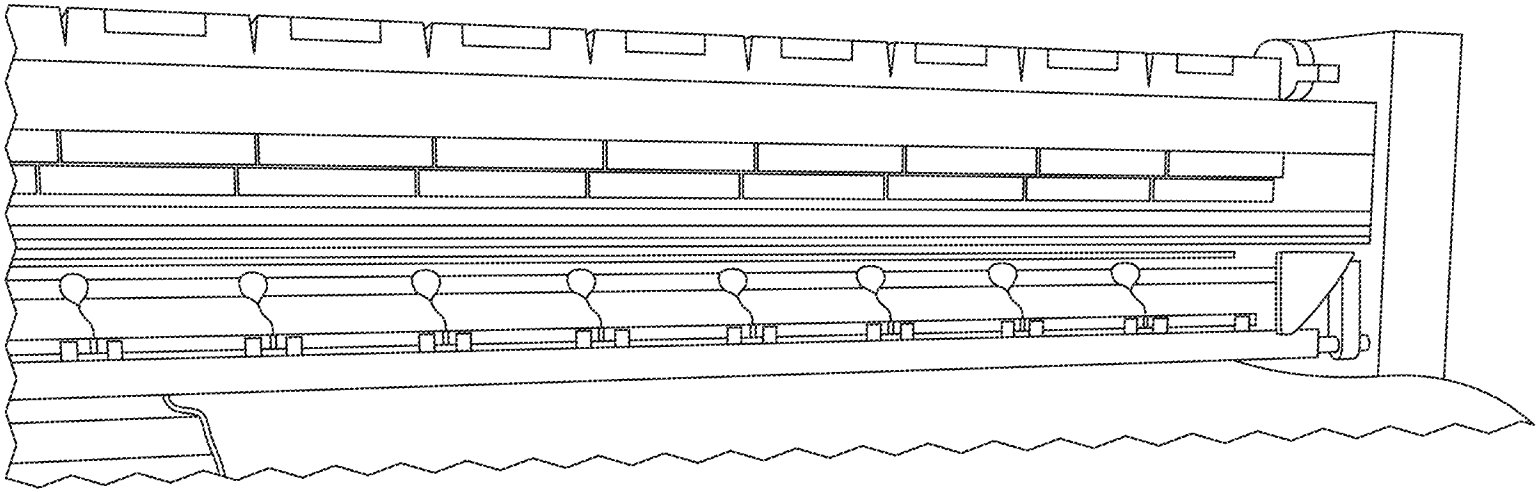

FIGS. 6*a*, 6*b* and 6*c* show photographs of an example of a printer apparatus, with FIG. 6*a* showing the capping mechanism in a capping position (i.e. when the printer apparatus is not in use), FIG. 6*b* showing the capping mechanism in the process of being folded, and FIG. 6*c* showing the capping mechanism in a completely folded position (with a printhead bar in a position ready for printing). The pivot point in this example is provided in a lower corner.

According to one example the printing fluid supply system 105 comprises mechanical and electrical units for printing four or more fluids, for example four or more colored inks. The printing fluid supply system may comprise fluid channels for communicating different inks to the various printhead modules, the printing dies on the printhead modules, and the nozzles on the printing dies.

According to one example the service sub-system 111 of the modular print engine unit 100 comprises a service carriage 119, and a service beam for mounting the service carriage 119. The axis of the service beam is arranged in parallel to the axis of a printhead bar mounting the set of printhead modules. The service beam allows the service carriage 119 to be moved during use to service the plurality of nozzles. Since a plurality of printhead modules can be located on the same printhead bar, this makes the service beam easier to locate next to it.

Figure 7A:
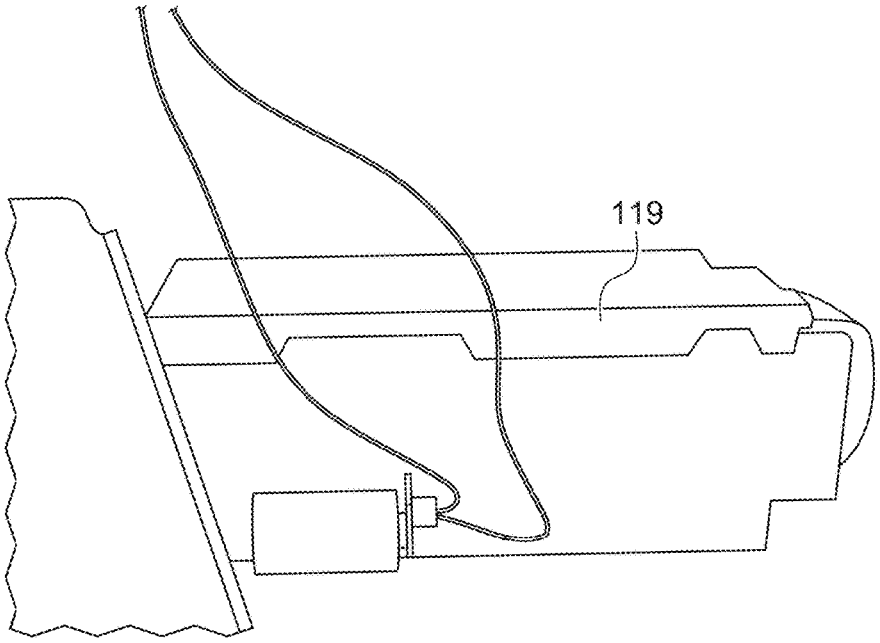
FIGS. 7*a* to 7*c* show photographs of an example of a service carriage of a service sub-system.
Figure 7B:
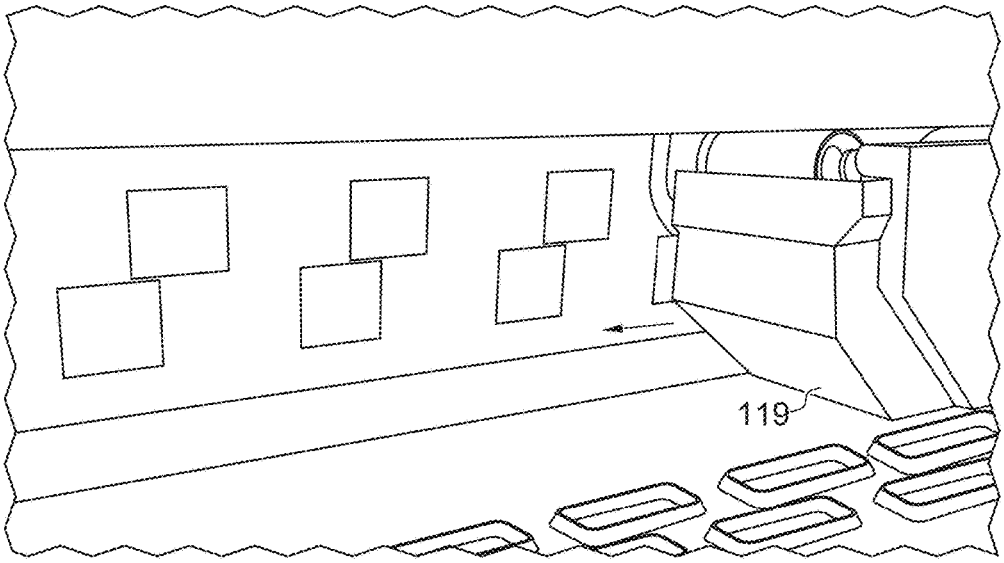
Figure 7C:
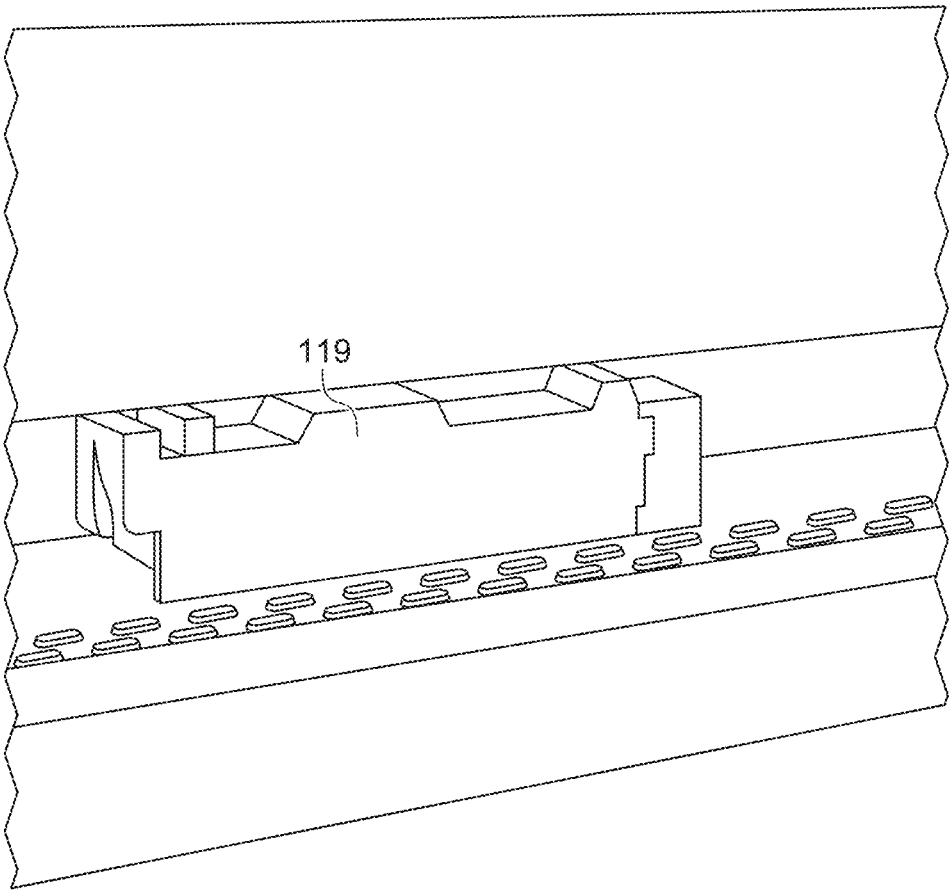

FIGS. 7*a* to 7*b* show photographs of an example of a service carriage 119 of a service sub-system 111. FIG. 7*a* shows the service carriage in a parking position, FIG. 7*b* the service carriage in a wiping operation, and FIG. 7*c* another view of a wiping operation.

The service carriage 119 may comprise a wiper mechanism to mechanically clean the plurality of nozzles as the service carriage moves along the service beam.

This enables the nozzles to be cleaned while the wiper mechanism is moved along the service beam. The wiper mechanism may comprise, for example, a textile element for cleaning the nozzles. The wiper mechanism and the web of textile move sideways when deployed during use (in the cross-media direction), thereby cleaning the nozzle plate of the printhead modules from its narrow side. When the wiper mechanism cleans the nozzles, some ink is sucked from them by the capillarity of the textile (which acts similar to a sponge). The wiper mechanism can be guided partly using a slider rod attached to the service beam, and partly by the structure of the capping mechanism. The means to move the wiper mechanism may comprise, for example, a motor, belt and encoder strip, which are connected using a trailing cable, all of which may be integrated in the modular print engine unit 100.

The service carriage 119 may further comprise a spittoon mechanism to keep the nozzles healthily spitting while they have not printed for a long time. The spittoon may be located close to the printzone. To spit, the printhead bar is raised and the spittoon deployed under the nozzle plate. The printhead bar is then moved on top of the spittoon to seal the nozzle plates while spitting to avoid aerosol generation. After spitting the process is reversed to return the printhead bar back to its printing position.

A blowing mechanism may be provided to blow ink out of the nozzles. For example a blow prime may be provided in the latching mechanism, and connected to the printhead module when the latch is closed. A protrusion may be provided on a top surface of the printhead module to allow air to be blown, that aligns with a blowing pump exhaust. The blowing mechanism has the advantage of enabling ink to be blown out of the nozzles during use, i.e. blow prime.

According to one example the print alignment module 107 of the modular print engine unit 100 comprises an optical sensor, for use in aligning the printhead modules. The print alignment module 109 may be provided in the service carriage. The optical sensor may comprise, for example, a plurality of illuminants (for example three or four LEDs of different colors), and can be used to align the printhead modules by sensing lines printed on the media, or to calibrate color (through the use of the different illuminants).

According to one example the error detection module 109 of the modular print engine unit 100 comprises a plurality of optical drop detectors for detecting malfunction of a nozzle 103. The error detection module may comprise, for example, twelve optical detectors. The plurality of drop detectors may be provided on the service carriage 119, and wherein the detection is performed by moving the service carriage 119 along the printhead bar while spitting the nozzles.

Figure 8:
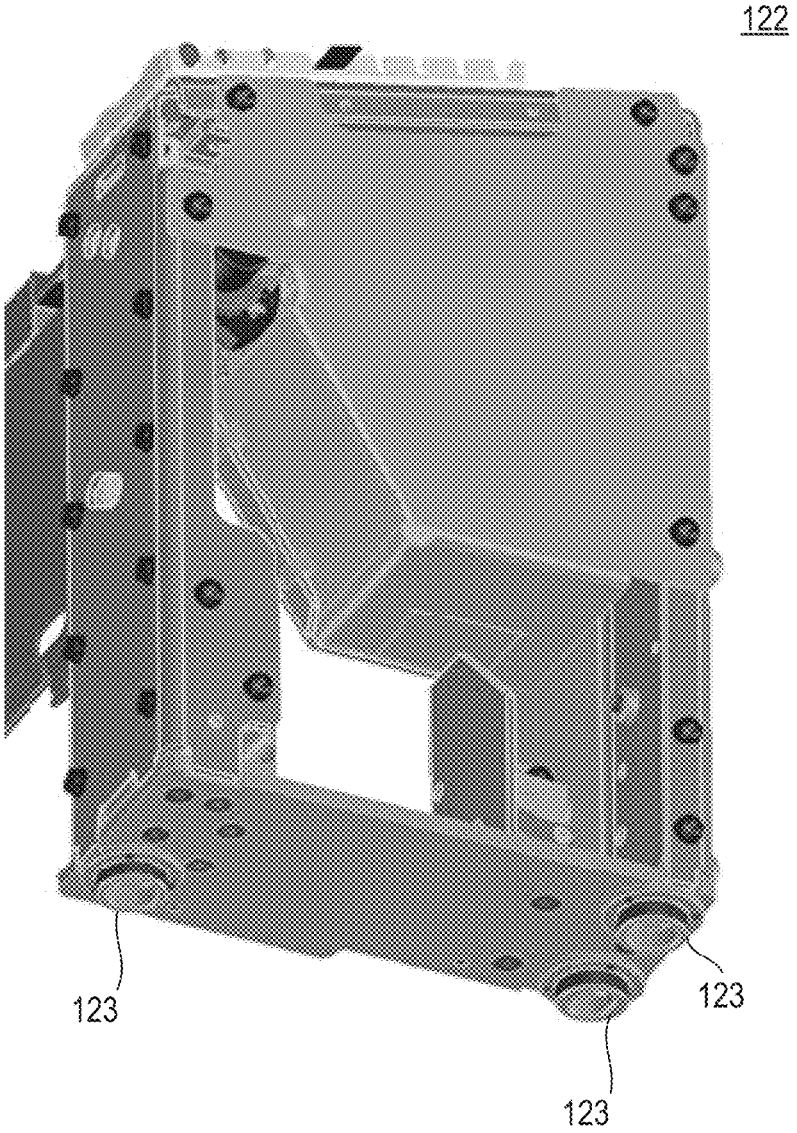
FIG. 8 shows an example of a side-plate.

Referring to FIG. 8, according to one example, the modular print engine unit 100 of FIG. 1 further comprises first and second side-plates 122, an example of which is shown in FIG. 8, wherein each side-plate 122 supports a stationary part of the modular print engine unit 100. A first and second of such side-plates 122 provide a datum (for example using datum elements 123) for the modular print engine unit 100 with respect to the remainder of a page-wide array printing apparatus into which the modular print engine unit 100 is incorporated. FIG. 8 shows the datum elements 123 on a lower part of a side-plate 122, that locate accurately the modular print engine unit 100 into the structure of a printer apparatus.

Figure 9B:
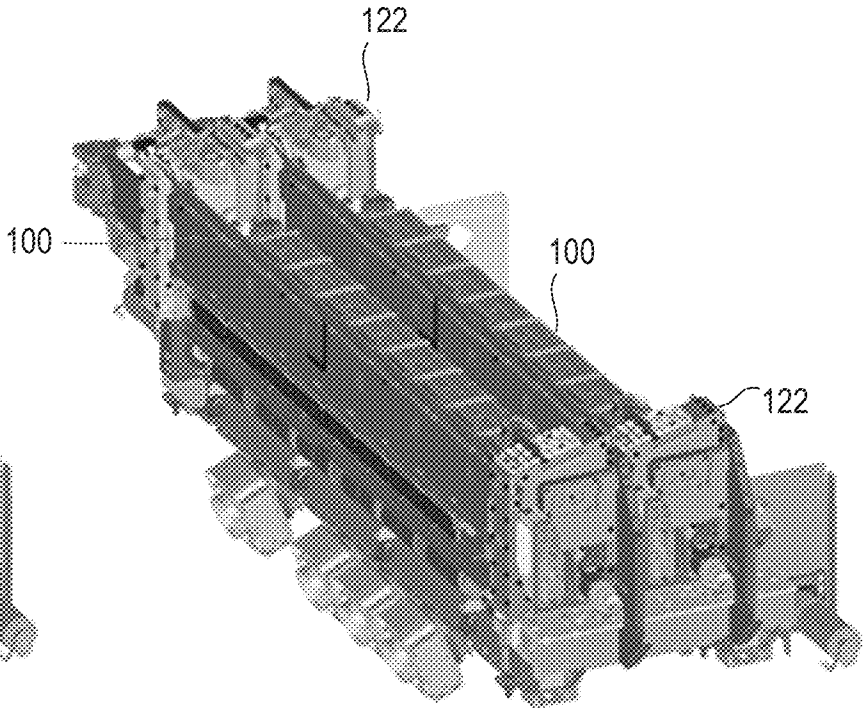
FIGS. 9*a* and 9*b* are examples showing a modular print engine unit in an example of an application.
Figure 9A:
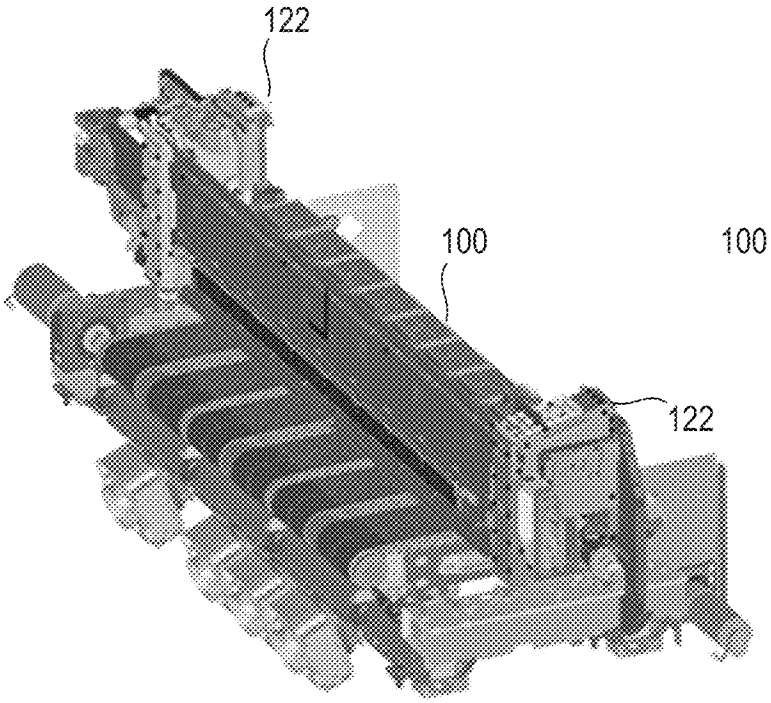

FIG. 9*a* shows an example of a printer apparatus comprising one modular print engine unit 100. FIG. 9*b* shows an example of a printer apparatus comprising two modular print engine units 100, spaced 210 mm apart for example. It can be seen that the narrow section of the modular print engine unit 100 allows a compact machine layout. The width of a printer apparatus can be grown by adding more S-shaped printhead modules together on a common axis to form a longer printhead bar, and hence a longer modular print engine unit. The S-shaped printhead modules therefore provide scalability.

Having more than one modular print engine unit 100 arranged in parallel as shown in FIG. 9*b* enables redundancy to be provided, that can be used, for example, for hiding defects. For example, a faulty nozzle may be replaced, or small variances of color may be averaged between dies.

The examples described above provide a means of printing four or more colors, while having a narrow printzone due to the S-shape disposition of its printhead modules. The printhead modules can be serviced, which includes capping, wiping, spitting, printhead blow priming. The examples also provide drop detection in order to detect the operating status of the nozzles, such as correct operation of the nozzles, and provide the hardware for printhead module alignment. These features allow for replacement of a printhead module by a non-trained user. In addition, the examples described above provide this functionality in a compact way (for example a 210 mm depth in an example of an implementation) which enables the use of multiple printhead bars in parallel in a reasonable space and minimizes the image quality errors that grow with the distance between print engines.

The examples are modular with a clear set of interfaces which simplifies its reuse in different printer architectures and sizes.

It can be seen from the above that the examples provide a modular print engine with its own structure that includes the components needed to print and maintain the health of the nozzles over time.

The examples described above provide a modular print engine unit that can print with accuracy, and with means to feed ink, power and data to the printhead modules. Means are provided to keep the nozzles in good condition while not using them, protecting them from drying (for example by using a capping station or mechanism). A spittoon can be provided for keep the nozzles healthy spitting while they have not printed for a long time. Means for mechanically cleaning the nozzles from dirt fibers or ink accumulation may be provided (in the form of a wiper mechanism). Means may also be provided to clean blowing ink out of the print-heads (i.e. blow prime). Alignment means for aligning the printhead modules is also provided, such that no step between them is noticeable in the printed media. An error detection module is provided for detecting missing or malfunctioning nozzles. The error detection module may comprise an optical drop detector, for example. The examples include mechanisms to accommodate to different media thickness (for raising the printhead modules during printing depending on the thickness of the media or other factors).

This functionality is provided in the compact modular print engine units that are used to form a page-wide array printing apparatus. This compactness is advantageous in applications where several of the modular print engine units are used in a given printer configuration, in order to have better image quality by means of having redundancy of the drops, or to fit more inks to have a larger color gamut.

The modular architecture also enables the modular print engine units to be easily reused in a wide range of printer architectures, which has the advantage of spreading the development costs of such modular print engine units.

The examples allow even a non-trained user to replace part of the array (the printhead modules) to increase reliability.

According to one example a modular print engine unit 100 comprises multiple printhead modules $\mathbf{101}_1$ to $\mathbf{101}_N$, each printhead module 101 comprising multiple printing dies $\mathbf{104}_1$ to $\mathbf{104}_M$, and each printing die 104 comprising multiple nozzles 103; a printing fluid supply system 105 to feed, in use, printing fluid to the printhead modules. The modular print engine unit comprises a print alignment module 107 operable, in use, to align the multiple printhead modules, for example relative to a media being printed, and further comprises at least one of: an error detection module 109 operable, in use, to detect proper operation of the multiple nozzles; and a service sub-system 111 operable, in use, to service the multiple nozzles.

The examples provide a modular architecture which is scalable to any width of printer apparatus.

A printer apparatus, for example a media-wide array printing apparatus, may comprise a modular print engine unit 100 as described in any of the examples above, or a plurality of modular print engine units 100 as described above.

It should be noted that the above-mentioned examples illustrate rather than limit the invention, and that those skilled in the art will be able to design many alternative examples without departing from the scope of the appended claims. The word "comprising" does not exclude the presence of elements or steps other than those listed in a claim, "a" or "an" does not exclude a plurality, and a single processor or other unit may fulfill the functions of several units recited in the claims. Any reference signs in the claims shall not be construed so as to limit their scope.

What is claimed is:

1. A modular print engine unit for a media-wide array printer, the modular print engine unit comprising:

multiple printhead modules, each printhead module comprising multiple printing dies, each printing die comprising multiple nozzles; and wherein the modular print engine unit is independently operable relative to another modular print engine unit within the media-wide array printer.

2. The modular print engine unit of claim 1, wherein the printing dies are overlappingly arranged to cover the length of a printhead module.

3. The modular print engine unit of claim 1, wherein:

the multiple printhead modules are arranged on a common printhead axis, a first end of each of the printhead modules comprises a first protruding printing die, the first protruding printing die overlapping with a second protruding printing die from a first adjacent printhead module adjacent to the first end, and a second end of each of the printhead modules comprises a third protruding printing die overlapping with a fourth protruding die from a second adjacent printhead module adjacent to the second end.

4. The modular print engine unit of claim 1, comprising a printhead bar for mounting the set of printhead modules along a common printhead axis.

5. The modular print engine unit of claim 4, comprising a lifting mechanism coupled to the printhead bar to move the printhead bar towards or away from the media being printed.

6. The modular print engine unit of claim 5, wherein the lifting mechanism comprises:

a guide rod to guide the lifting mechanism as the printhead bar is moved;

a lift actuator to lift the printhead bar; and a synchronization rod to synchronize the lifting of the respective ends of the printhead bar.

7. The modular print engine unit of claim 5, wherein the lift actuator comprises a rack and a pinion, the rack and the pinion being mechanically coupled to a drive motor and a gear mechanism.

8. The modular print engine unit of claim 4, wherein the printhead bar comprises a printhead bar interface to couple with a respective printhead module interface on the set of printhead modules.

9. The modular print engine unit of claim 8, wherein the interface comprises:

a plurality of mechanical interfaces to locate the set of printhead modules accurately;

a plurality of fluid interfaces to feed the set of printhead modules with printing fluid; and a plurality of electrical interfaces to feed the set of printhead modules with power and data.

10. The modular print engine unit of claim 5, wherein the printhead bar comprises a latching mechanism for attaching and detaching the printhead modules to the printhead bar.

11. The modular print engine unit of claim 1, comprising a capping mechanism pivotally coupled to a static portion of the modular print engine unit.

12. The modular print engine unit of claim 1, comprising a printing fluid supply system to feed printing fluid to the multiple printhead modules, the printing fluid supply system comprising mechanical and electrical units to provide a plurality of colored print fluids to the multiple printhead modules.

13. The modular print engine unit of claim 1, comprising a service sub-system to service the multiple nozzles, wherein the service sub-system comprises:

a service carriage; and a service beam for mounting the service carriage, wherein the axis of the service beam is arranged in parallel to the axis of a printhead bar mounting the set of printhead modules, and wherein the service carriage comprises a wiper mechanism to mechanically clean the multiple nozzles as the service carriage moves along the service beam.

14. The modular print engine unit of claim 1, comprising a side-plate to support a stationary portion of the modular print engine unit.

15. The modular print engine unit of claim 14, wherein the side-plate comprises a number of datum elements into which the modular print engine unit seats to locate the modular print engine unit with respect to the remainder of a page-wide array printing apparatus into which the modular print engine unit is incorporated.

16. A media wide array printing device comprising:

a plurality of modular print engine units arranged in series along a media advance direction, wherein each modular print engine comprises:

multiple printhead modules, each printhead module comprising multiple printing dies, each printing die comprising multiple nozzles; and wherein the modular print engine unit is independently operable relative to another modular print engine unit within the media-wide array printer.

17. The media wide array printing device of claim 16, comprising:

a printhead bar for mounting the printhead modules along a common printhead axis;

a lifting mechanism coupled to the printhead bar to move the printhead bar towards or away from the media being printed, the lifting mechanism comprising:

a guide rod to guide the lifting mechanism as the printhead bar is moved;

a lift actuator to lift the printhead bar; and a synchronization rod to synchronize the lifting of the respective ends of the printhead bar.

18. The media wide array printer of claim 17, wherein the lift actuator comprises a rack and a pinion, the rack and the pinion being mechanically coupled to a drive motor and a gear mechanism.

19. The media wide array printing device of claim 18, comprising a side-plate to support a stationary portion of the modular print engine unit, wherein the side-plate comprises a number of datum elements into which the modular print engine unit seats to locate the modular print engine unit with respect to the remainder of a page-wide array printing apparatus into which the modular print engine unit is incorporated.

20. The media wide array printing device of claim 16, comprising:

a capping mechanism, wherein the capping mechanism is pivotably coupled to a static part of the modular print engine unit; and a print alignment module to align the multiple printhead modules.

* * * * *